US006290302B1

(12) United States Patent
Boucherie

(10) Patent No.: US 6,290,302 B1
(45) **Date of Patent: *Sep. 18, 2001**

(54) METHOD FOR MANUFACTURING BRUSHES AND BRUSH MANUFACTURING MACHINE APPLYING THIS METHOD

(75) Inventor: Bart Gerard Boucherie, Izegem (BE)

(73) Assignee: Firma G.B. Boucherie, Naamloze Vennootschap, Izegem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/353,008

(22) Filed: Jul. 13, 1999

(30) Foreign Application Priority Data

Jul. 14, 1998 (BE) ..... 9800537

(51) Int. Cl.[7] ..... A46D 1/08; A46D 9/06
(52) U.S. Cl. ..... 300/3; 300/11; 300/21
(58) Field of Search ..... 300/4, 5, 7, 8, 300/10, 11, 18–20, 21

(56) References Cited

U.S. PATENT DOCUMENTS 4,768,837 * 9/1988 Boucherie ..... 300/21
5,033,797 * 7/1991 Rueb ..... 300/21
5,104,196 * 4/1992 Boucherie ..... 300/21
5,352,025 * 10/1994 Huang ..... 300/21
5,390,984 * 2/1995 Boucherie et al. ..... 300/21
5,518,301 * 5/1996 Boucherie ..... 300/21
5,533,791 * 7/1996 Boucherie ..... 300/4

FOREIGN PATENT DOCUMENTS 0 346 646 A2 12/1989 (EP) .
0 567 672 A1 11/1993 (EP) .

* cited by examiner

*Primary Examiner*—Terrence R. Till

(57) ABSTRACT

Method for manufacturing brushes, characterized in that a device is applied consisting of at least one carrier (2) with openings (3) which are mutually arranged according to a certain pattern, whereby the fiber bundles which have to be provided in a brush body (5) can be put in this carrier (2), and whereby this method further consists in the combination of at least four steps (6-8-9-11), respectively, the lateral separation of fiber bundles (4) from at least one quantity of loose fibers (7); the provision, in a mechanical manner, step-by-step, of the aforementioned fiber bundles (4) in the aforementioned carrier (2); the transfer of the fiber bundles (4) which are placed in the carrier by means of this carrier (2) to a holder (10); and, by means of this holder (10), the fixation of the fiber bundles (4) in the brush body (5), or at least in a portion of the brush body.

25 Claims, 10 Drawing Sheets

Fig. 18
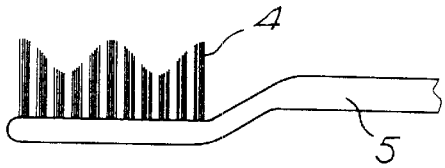
Fig. 19
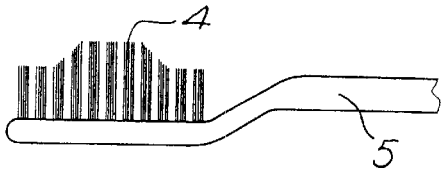
Fig. 20
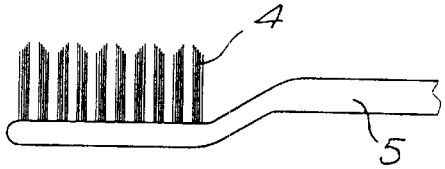
Fig. 21
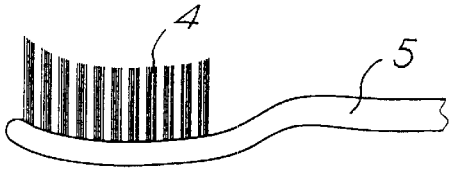
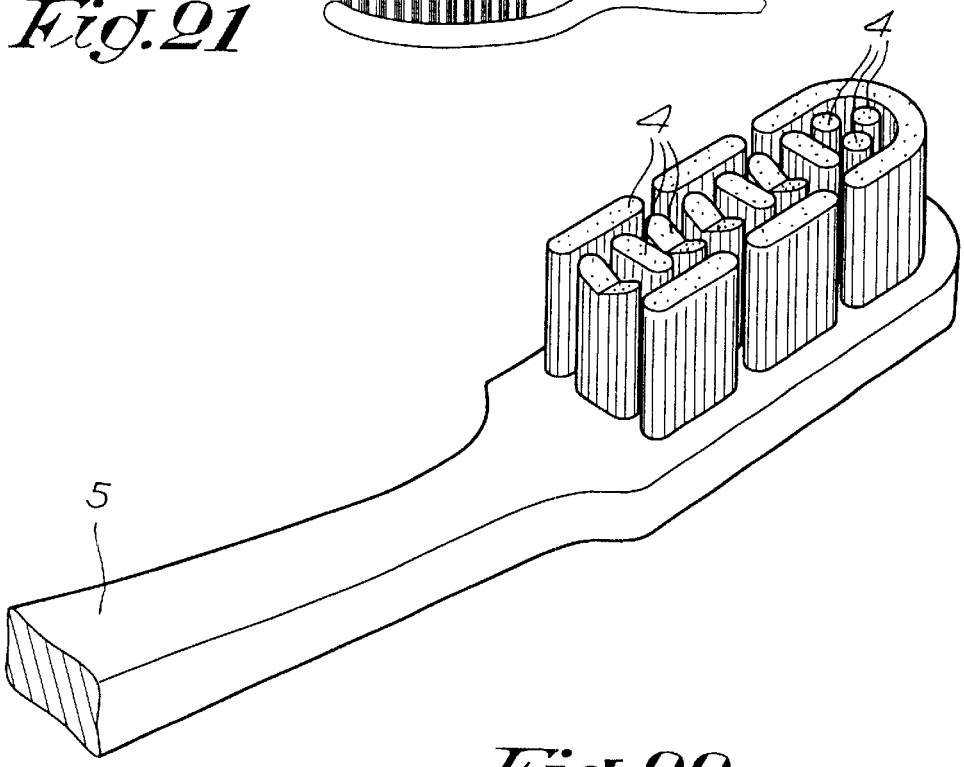
Fig. 22

METHOD FOR MANUFACTURING BRUSHES AND BRUSH MANUFACTURING MACHINE APPLYING THIS METHOD

BACKGROUND OF THE INVENTION

1. Field of the Invention

This invention relates to a method for manufacturing brushes, as well as to a device, more particularly a brush manufacturing machine, applying this method.

2. Description of the Prior Art

For manufacturing brushes, more particularly toothbrushes, substantially two techniques are known.

According to a first known technique, fiber bundles are fixed by means of anchoring plates in openings or holes in a brush body.

A big disadvantage of this technique consists in that it is only possible to work with fiber bundles of a single well-defined diameter, unless one and the same brush is manufactured on different machines.

According to a second known technique, fiber bundles are provided in holes or openings in brush bodies or in a portion of brush bodies, after which the fibers, at the extremities provided in the openings, are mutually connected. In consideration of the fact that no anchoring plates are applied therewith, the shape of the openings in which the fiber bundles are provided may be of any form.

The invention relates to a method which allows the realization of brushes according to the aforementioned second technique in a fast manner, whereby a variety of patterns of fibers to be inserted can be realized in a simple way.

SUMMARY OF THE INVENTION

To this aim, the invention relates to a method for manufacturing brushes, wherein a device is applied consisting of at least one carrier with openings which are mutually arranged according to a certain pattern, whereby the fiber bundles which have to be provided in a brush body can be put in this carrier, and whereby this method further consists in the combination of at least four steps, respectively, the lateral separation of fiber bundles from at least one quantity of loose fibers; the provision, in a mechanical manner, step-by-step, of the aforementioned fiber bundles in the aforementioned carrier; the transfer of the fiber bundles which are placed in the carrier by means of this carrier to a holder; and, by means of this holder, the fixation of the fiber bundles in the brush body, or at least in a portion of the brush body.

By using a step-by-step working method for providing the fiber bundles in the carrier, a systematic filling is obtained which allows for a large number of applications, whereby, during the provision of fiber bundles in a carrier, it is easy to supply successively fiber bundles with different fibers, amongst others of different kind, colour or dimensions, to the carrier.

As use is made of a carrier which, in itself, does not fulfil any shaping function for the brush body and which cooperates with a holder which preferably forms a pre-shaped part of a brush body, the requirements set for such carrier are less stringent, as a result of which it can easily be manipulated and can be manufactured in a very simple manner.

The use of a fiber bundle take-up device which, when passing alongside a fiber magazine, takes up fibers by means of a recess, either adjustable in size or not, in the take-up device, has as an advantage that it is possible to work at high speeds, which is very important within the scope of the method according to the present invention, considering that the carrier has to be filled step-by-step.

The separated fiber bundles preferably are provided in the aforementioned openings of the carrier by means of a mutual positioning between each respective fiber bundle and the opening, in which it has to be provided, and by subsequently pushing the fiber bundles into the aforementioned openings, which allows for a fast and easy to control systematic filling of the carriers.

More particularly, it is preferred that the separated fiber bundles are presented to the carrier at one location or a limited number of locations and that the carriers are positioned systematically with the respective openings opposite the aforementioned locations, which, in a practical form of embodiment, may be performed by placing the carriers on a positioning table, more particularly a table which can be positioned in two directions.

Preferably, carriers with through openings are applied, whereby the separated fiber bundles are pushed into the openings and, after the carrier is filled, with fiber bundles and is presented to the aforementioned holder, the fiber bundles taken up in the fiber holder are removed from the openings in order to be placed directly or indirectly in the aforementioned holder. Hereby, preferably use is made of carriers in the form of transport plates or small blocks, whereby the openings consist of through bores.

Further, the fiber bundles provided in the aforementioned holder preferably are provided from each respective carrier in the aforementioned holder by pushing them out of the carrier by means of ejection pins, which increases the universality of the method, as, by different choice of the applied ejection pins, it is easy to obtain different effects, such as, for example, a profile at the free extremities of the brush hair.

In consideration of the fact that, according to the invention, carriers are applied which fulfil no shaping function for the formation of the brush bodies, it is possible to place additional accessories, for example, fiber guidances, between these carriers and the holders. Hereby, fiber guidances can be applied which serve for different purposes, such as the combining of fiber bundles, the displacement of fiber bundles, or the provision of the fiber bundles in the brush bodies at an angle.

In the case that the holder forms a portion of the brush body, this holder can be attached at the actual brush body in any manner, either by means of a connection which is realized during manufacturing, for example, by ultrasonic welding, or by a connection which is realized by the user, for example, as he attaches the portion provided with fiber bundles in a brush handle or such, more particularly, clicks it into the latter.

The present invention also relates to a device which applies the aforementioned method and which consists in the combination of at least one fiber magazine with loose fibers; means for the lateral separation of fiber bundles from the fibers of the fiber magazine; a mechanism with at least one carrier in which openings are formed in which the aforementioned fiber bundles can be provided; and transfer means for presenting the carrier, carriers, respectively, filled with fiber bundles, to a holder by means of which holder the fiber bundles can be fixed into a brush body, or at least a portion of a brush body, in an appropriate manner.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein:

FIGS. 18 to 22 represent different brush bodies which can be manufactured with the method according to the invention;

DESCRIPTION OF PREFERRED EMBODIMENTS

Figure 1:
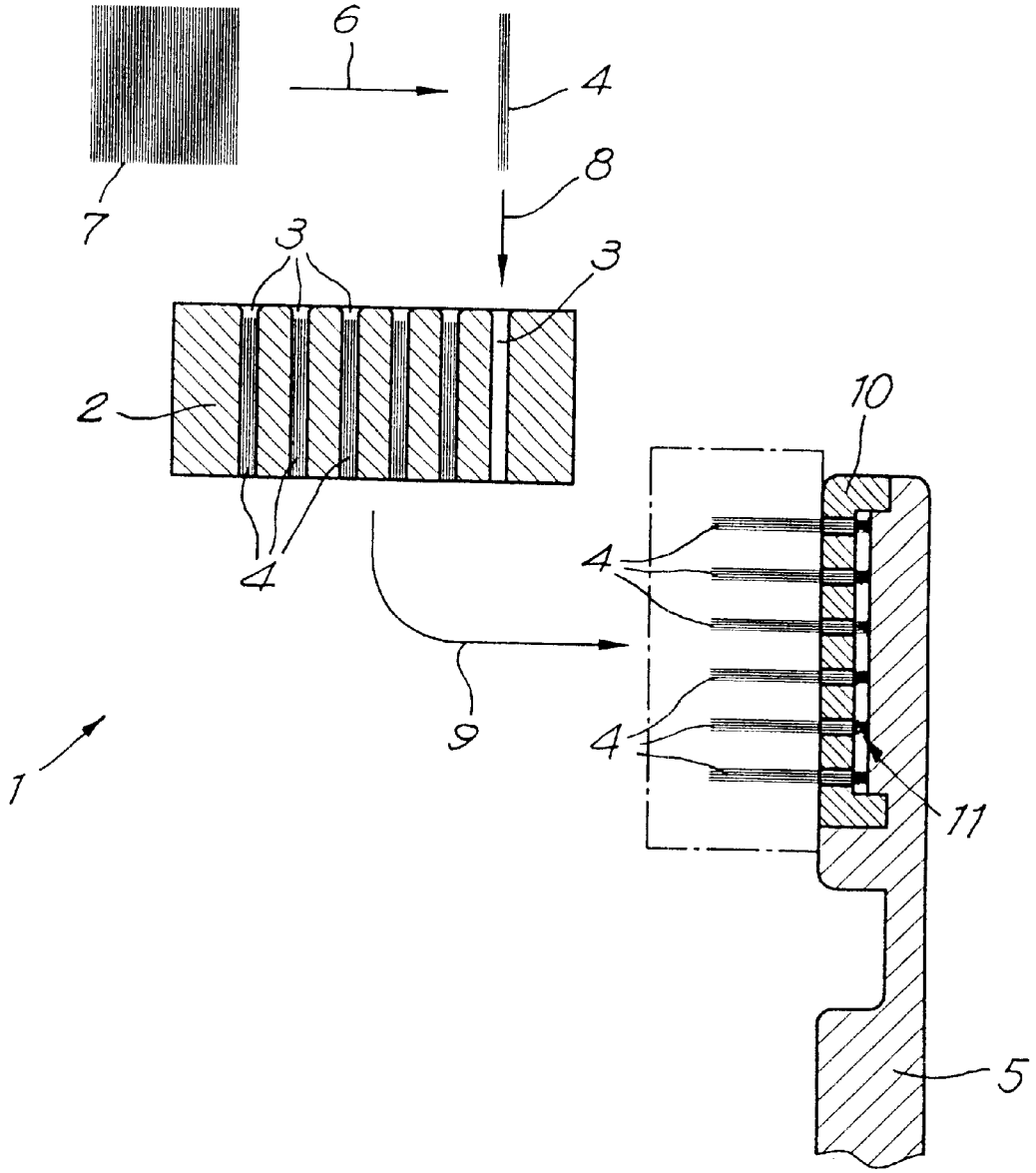
FIG. 1 schematically represents the method according to the invention.

In FIG. 1, the method according to the invention for manufacturing brushes is represented schematically, whereby for the supply of fibers, use is made of a device 1 with at least one carrier which is provided with openings 3 which are mutually arranged according to a certain pattern, whereby in this carrier 2, the fiber bundles 4 can be collected which have to be provided in a brush body 5.

Further, this method substantially consists in the combination of at least four steps, respectively, a first step 6 consisting in the lateral separation of fiber bundles 4 from at least one quantity of loose fibers 7; a second step 8 consisting in the step-by-step mechanical filling of the aforementioned carrier 2 with the aforementioned fiber bundles 4; a third step 9 consisting in the transfer of the fiber bundles 4 which are placed in the carrier 2 by means of this carrier 2 to a holder 10; and a fourth step 11 consisting in the fixation, by means of this holder 10, of the fiber bundles 4 in the brush body 5, or at least in a portion of the brush body 5.

The holder 10 represented in FIG. 1 consists in a preshaped portion of the brush body 5.

For the lateral separation of the fiber bundles 4, as represented in FIGS. 2 to 5, use shall be made of at least one fiber magazine 12 and a fiber bundle take-up device 13 cooperating therewith which is moved along the fibers 7 provided in the fiber magazine 12, whereby this fiber bundle take-up device 13 is provided with a recess 14 in which fibers 7 can be taken up as this recess 14 passes alongside the fiber magazine 12.

Figure 2:
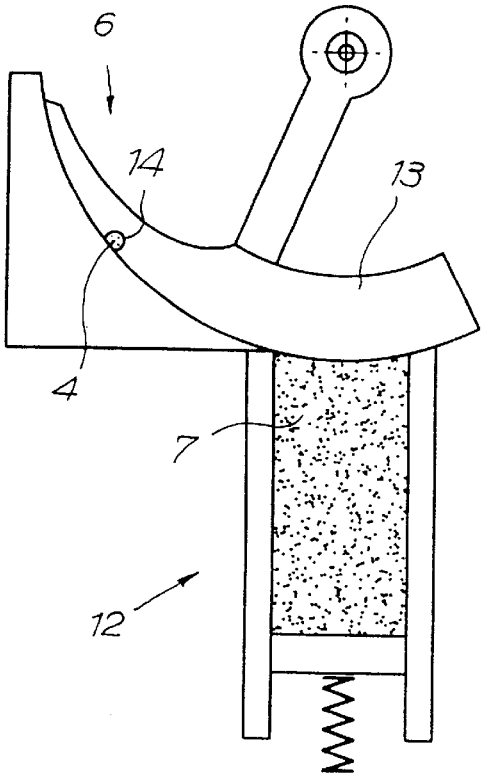
FIGS. 2 and 3 schematically represent means for the separation of fiber bundles.
Figure 4:
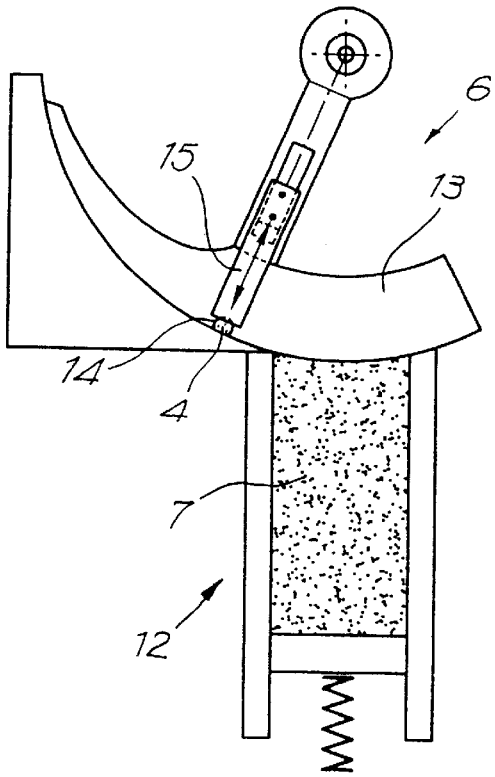
FIGS. 4 and 5 represent two particular forms of embodiment of the means depicted in FIGS. 2 and 3.
Figure 3:
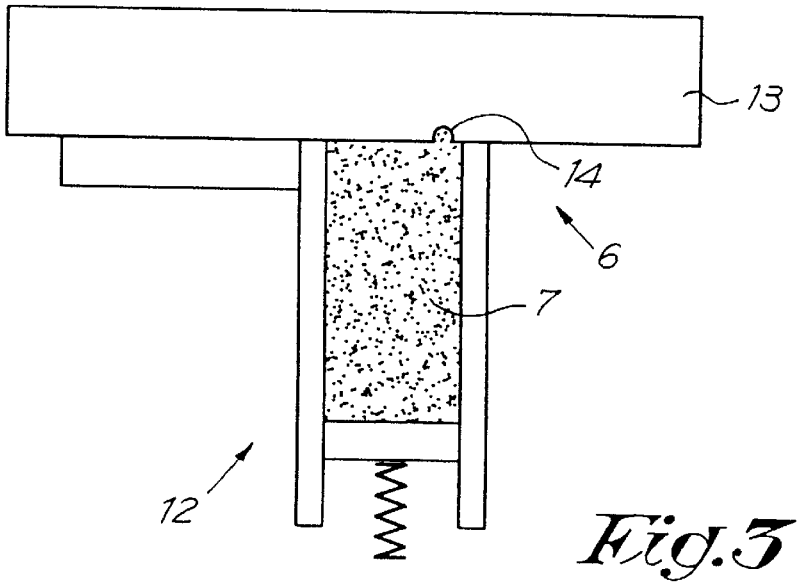
Figure 5:
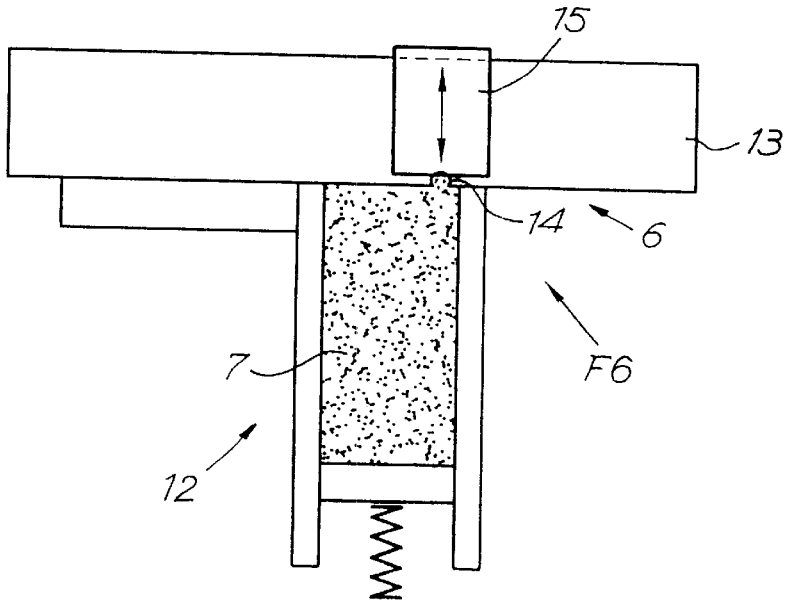
Figure 6:
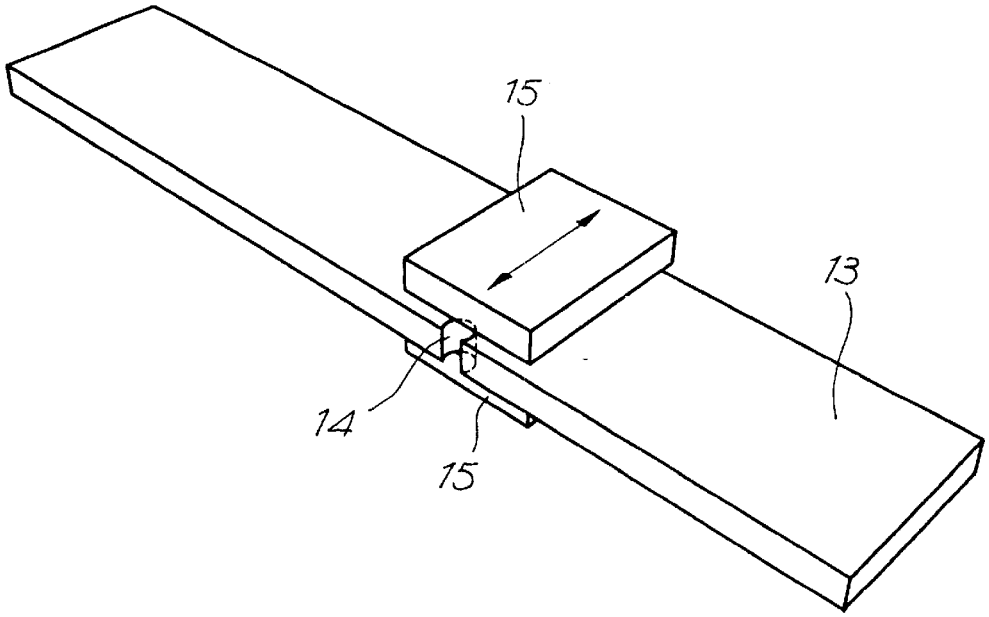
FIG. 6, at a larger scale and in perspective, represents a view according to arrow F6 in FIG. 5.

In the embodiment according to FIGS. 2 and 4, the fiber bundle take-up device is designed rotative, whereas in the embodiments according to FIGS. 3, 5 and 6, the fiber bundle take-up device 13 is designed straight.

In FIGS. 4, 5 and 6, it is represented in a schematic manner that the recess 14 in the fiber bundle take-up device 13 can be adjusted in size, by shifting a slide 15 or such, in order to take up more or less fibers off a magazine 12.

Figure 7:
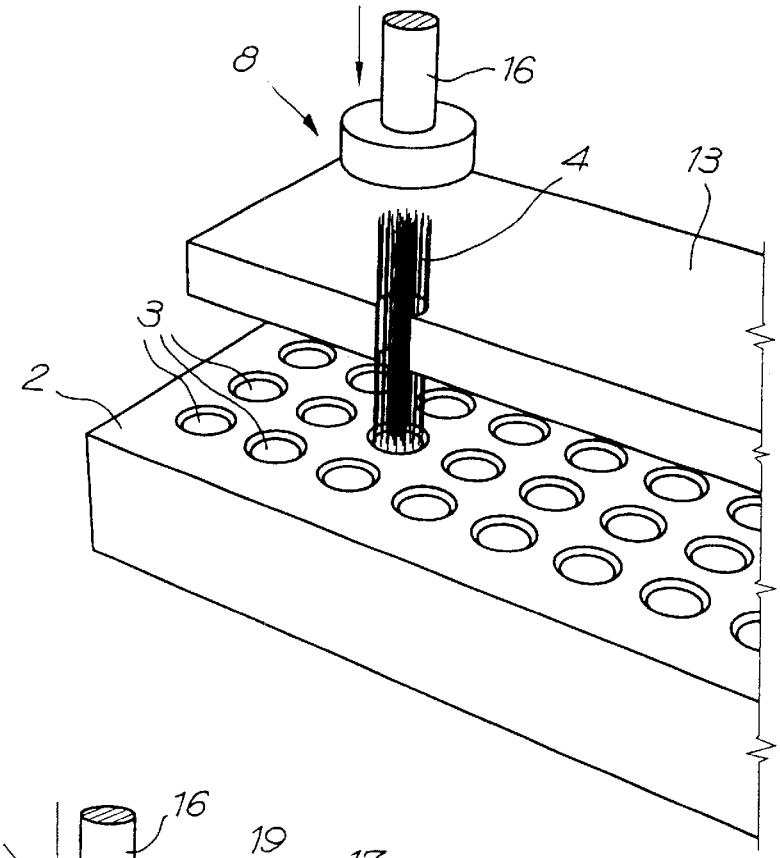
FIGS. 7 and 8 schematically represent how the separated fiber bundles can be placed in a carrier.
Figure 8:
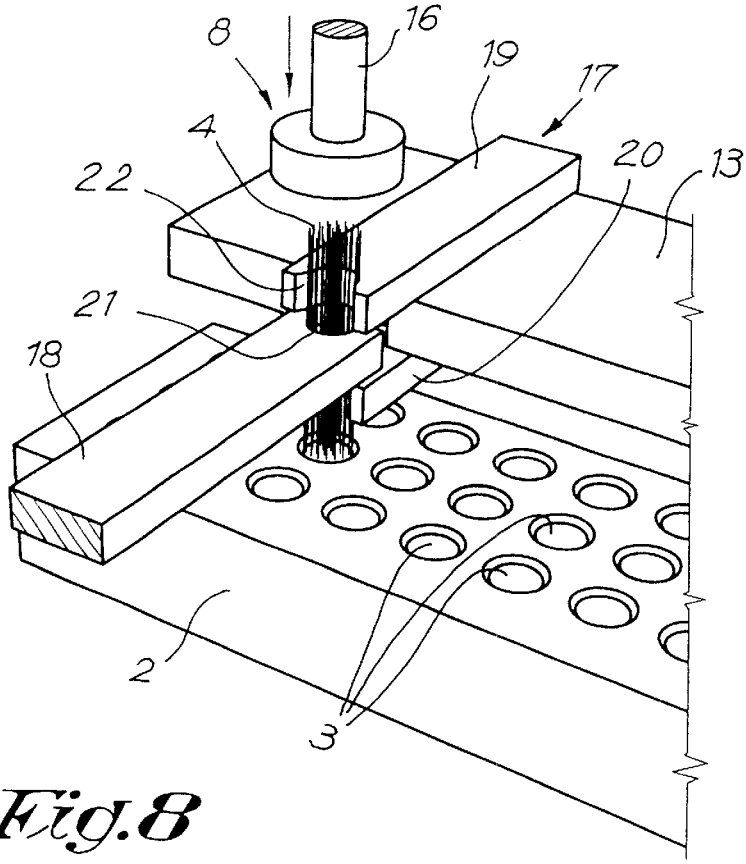

In FIG. 7, it is represented schematically that the separated fiber bundles 4 are brought into the openings 3 of the carrier 2 by positioning these fiber bundles 4 in an appropriate manner in respect to the respective openings 3 and subsequently pushing these fiber bundles axially into the respective openings 3, for example, by means of a punch 16.

In order to position the fiber bundles 4 even better in respect to the openings 3 of the carrier 2, use shall be made of transfer device or means 17 which, in this case, are formed by a central lath 18 and two exterior laths 19, 20, whereby the extremities thereof facing each other show recesses, respectively 21 for lath 18 and 22 for the laths 19 and 20, whereby in this case these recesses have a semicircular shape.

As the openings 3 may show other shapes than a cylindric shape, also the shape of the recesses 21 and 22 may correspond to the shape of the openings 3, in such a manner that the fiber bundles 4 which are separated by a fiber bundle take-up device 13 are pushed, by means of the laths 18, 19 and 20, into the appropriate shape before being inserted into the openings 3.

Figure 9:
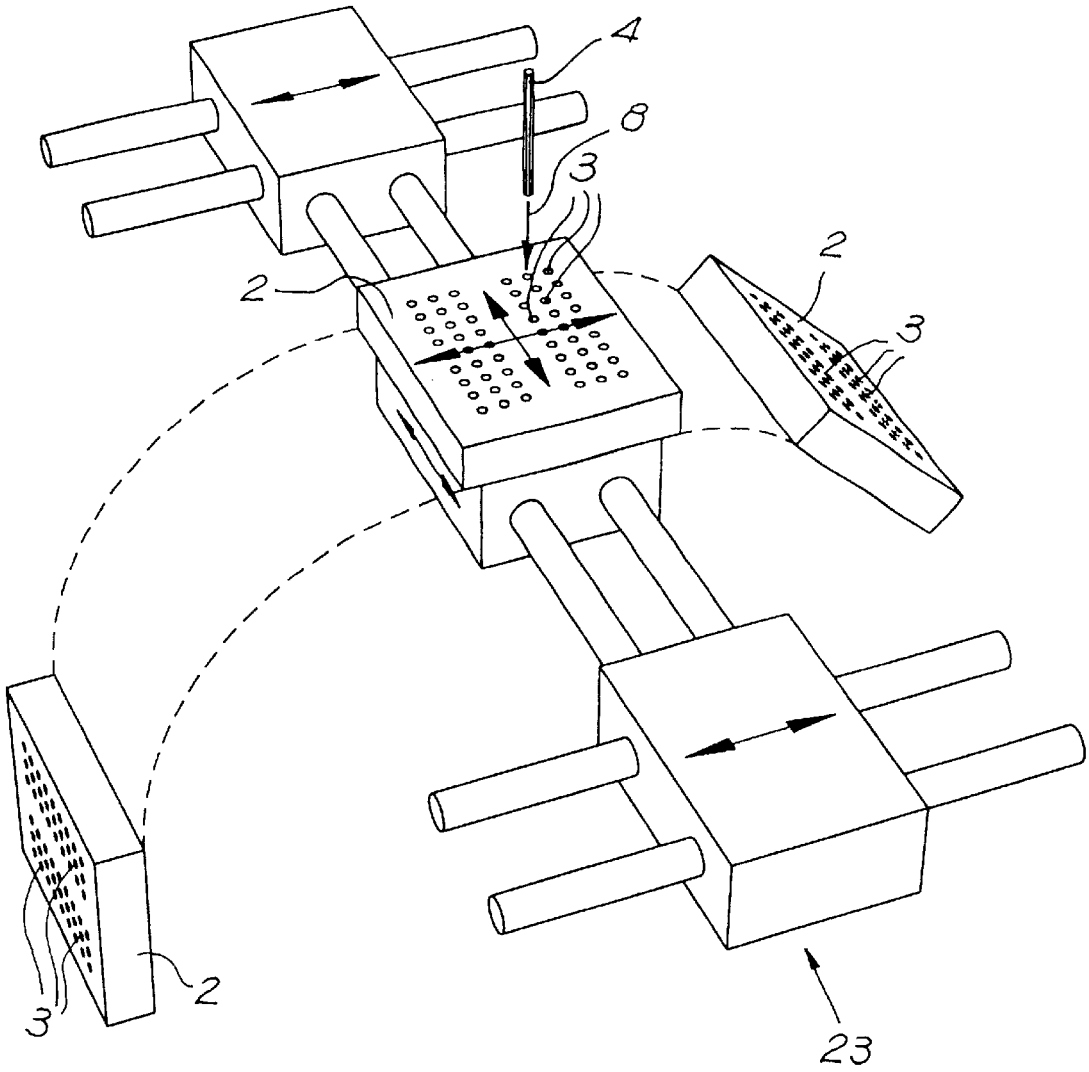
FIG. 9 schematically represents how different carriers successively can be filled with separated fiber bundles in a systematic manner.

In FIG. 9, a device is represented schematically whereby the carriers 2 are moved in an appropriate manner by means of a device 23, in longitudinal direction as well as in perpendicular direction, in order to bring the openings 3 thereof successively under a location where the fiber bundles 4 are removed from the fiber bundle separation device 13 in order to be provided in the openings 3 and thus providing successively a fiber bundle 4 in the different openings, whereby carriers 2 can be supplied to this device 23 one by one in an appropriate manner.

Figure 10:
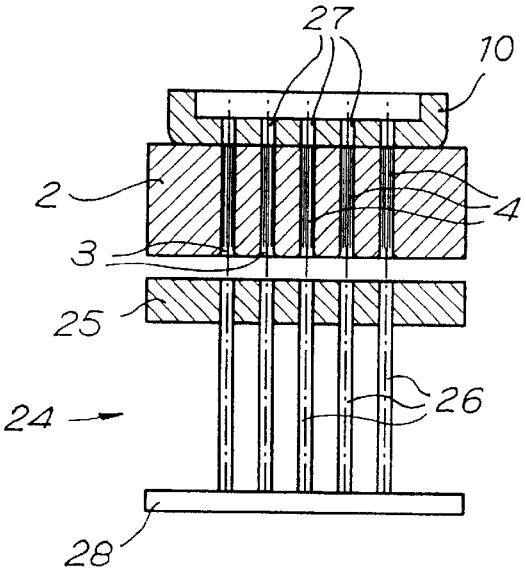
FIGS. 10 and 11 represent how the fiber bundles can be transferred from the aforementioned carrier into a holder.
Figure 11:
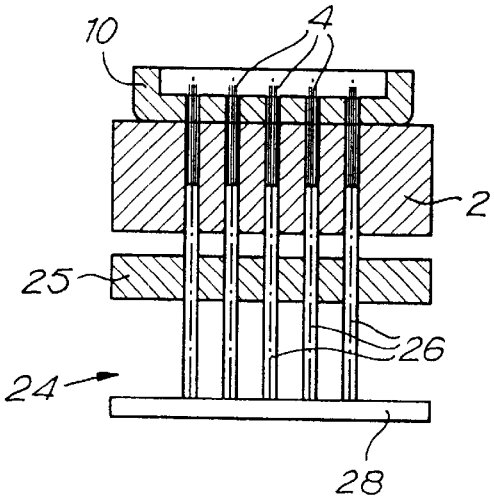

In FIGS. 10 and 11, an embodiment is represented schematically whereby a carrier 2 filled with fiber bundles 4 is brought against a holder 10 by means of transfer means not represented in the figures, and whereby at the other side of the carrier 2, a device 24 is provided which is intended for moving the fiber bundles 4 from the carrier 2 into the holder 10.

To this aim, this device 24 consists of a guidance plate 25 on which ejection pins 26 are provided, according to a pattern which corresponds to the pattern of the openings 3 in the carrier 2, the pattern of the holes or passages or openings 27 provided in the holder 10, respectively, whereby these ejection pins 26 are attached, for example, on a common support 28.

It suffices, as represented in FIG. 11, to move the ejection pins 26 in the openings 3 of the carrier 2 in order to move the fiber bundles 4 into the holder 10, in such a manner that the free extremities of these fiber bundles 4 protrude from the aforementioned openings 27 with an appropriate length.

Figure 12:
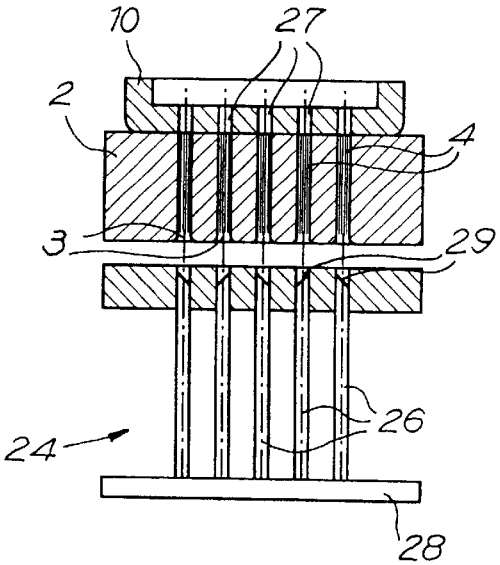
FIGS. 12 and 13 represent a variant of the embodiment according to FIGS. 10 and 11.
Figure 13:
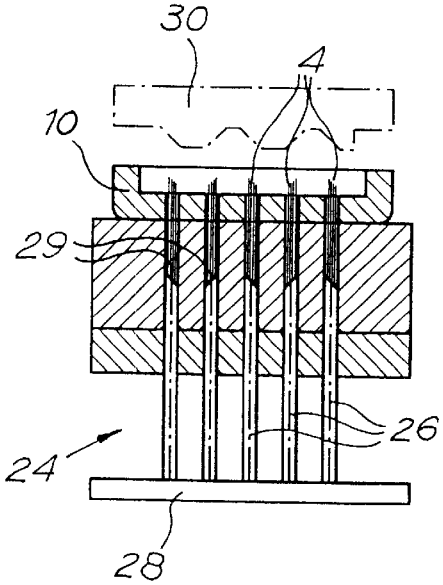

In FIGS. 12 and 13, an embodiment is represented similar to that of FIGS. 10 and 11, but whereby the ejection pins 26 show an inclination 29 at their free extremity, in such a manner that the fiber bundles 4 are positioned in the holder 10 corresponding to the inclinations 29.

In dash-dot line, a pressure element 30 is represented in FIG. 13 with which the same result can be obtained, by treating the fiber bundles 4, after their insertion into the holder 10, by beating thereupon and/or subjecting them to a vibration in order to obtain the appropriate end position. This pressure element 30 may also be applied in combination with the ejection pins 26, as a beating element for positioning the fibers against the extremities of the ejection pins 26.

Finally, by varying the length of the pins 26, the fiber bundles shall be brought more or less into the holder 10, as a result of which, in this respect, too, a certain profile of the extremities of the fiber bundles can be obtained.

Figure 14:
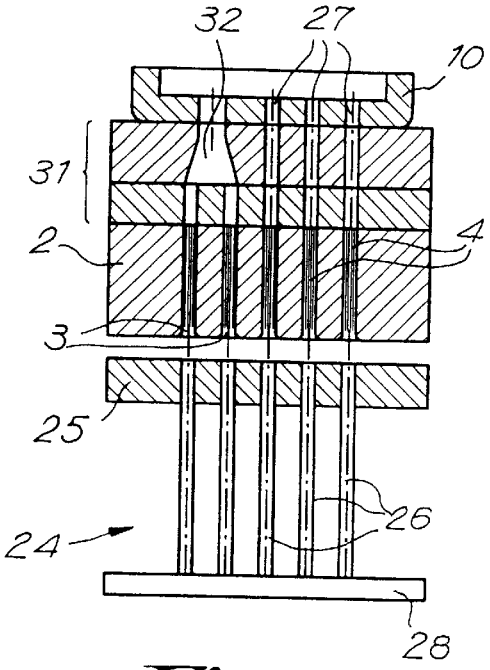
FIGS. 14 and 15, in two positions, represent an embodiment whereby use is made of an additional fiber guidance.
Figure 15:
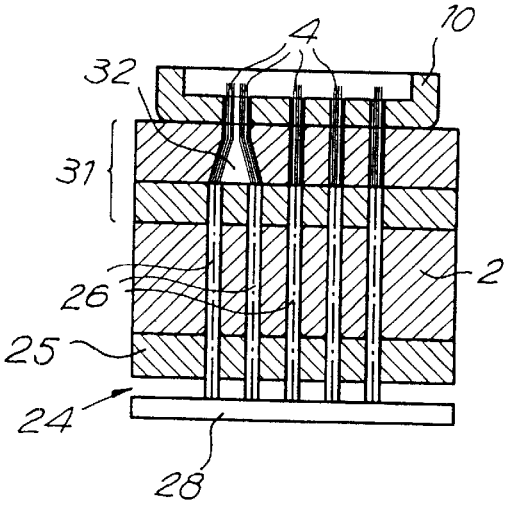

In FIGS. 14 and 15, an embodiment is represented whereby between the carrier 2 and the holder 10 a fiber guidance 31 is provided which is intended, as becomes clear from the drawings, to bring together two or more fiber bundles 4 in the holder 10, by means of a, for example, funnel-shaped guidance 32.

Figure 16:
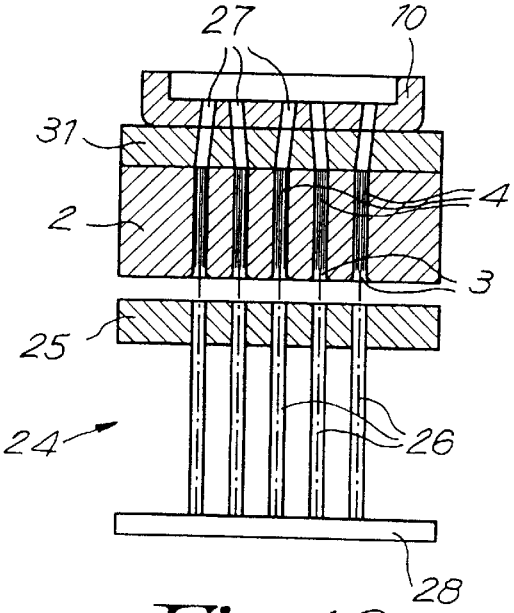
FIGS. 16 and 17 represent a variant whereby another fiber guidance is used.
Figure 17:
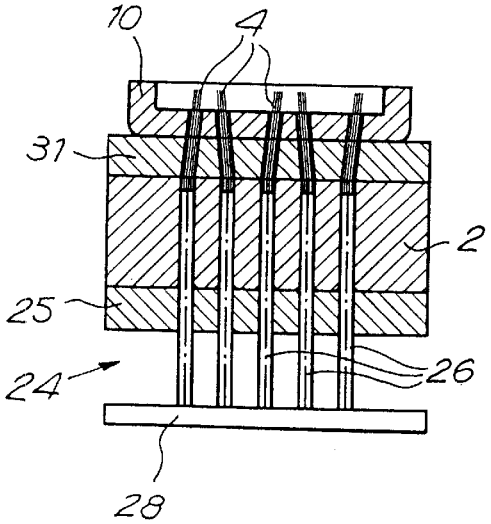

In the embodiment according to FIGS. 16 and 17, the fiber guidance 31 has as a function to guide the fiber bundles 4 to another location, whether or not with the intention of placing these fiber bundles in the holder 10 at a certain angle.

In FIGS. 18 to 22, examples of, in this case, toothbrushes are represented schematically, whereby, in accordance with the aforementioned manner, the fiber bundles 4 are provided in an appropriate manner, in order to realize certain patterns in the horizontal plane as well as in the vertical plane.

In FIG. 22, a particular embodiment is represented whereby at certain locations, by the combination of fiber bundles, certain continuous fiber bundle arrangements are obtained.

Figure 23:
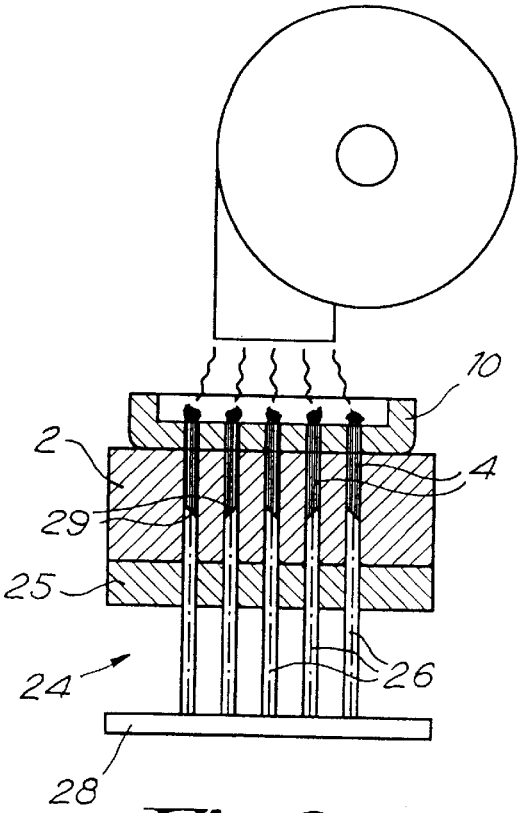
FIGS. 23, 24 and 25 schematically represent a number of possibilities for fixing the fiber bundles in a holder.

When the fiber bundles 4, in the manner as described in the aforegoing, are provided in a holder 10, the free extremities of the fibers, as represented, for example, in FIG. 23, will be melted together, for example, under the influence of heat, whereby it is obtained at the same time that, in this way, the fiber bundles are retained in the holder.

Figure 24:
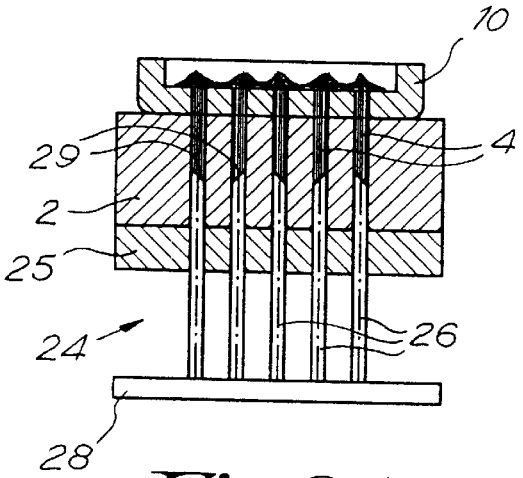

In FIG. 24, an application is represented whereby the extremities of the fiber bundles protruding in the holder 10 are chosen with such a length that not only the fibers of a single fiber bundle are melted together, but, at the same time, the fibers of adjacent fiber bundles are connected to each other, such that one whole is obtained which, in heated condition, preferably is compressed.

Figure 25:
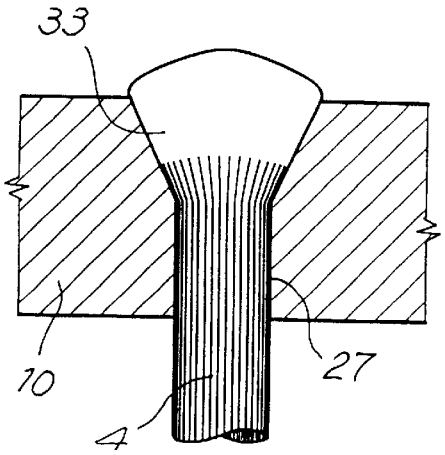

In a particular embodiment, as represented in FIG. 25, the openings 27 in the holder 10 will show an enlargement 33, as a result of which the fiber bundles 4 are additionally fixed in the openings 25.

Figure 26:
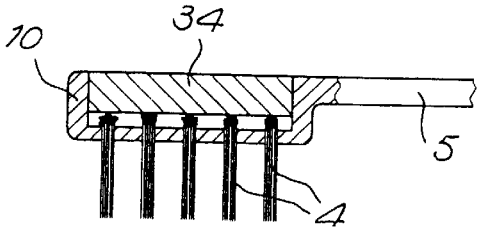
FIGS. 26 and 27 in cross-section represent two brush bodies which are manufactured with the method according to the invention.
Figure 27:
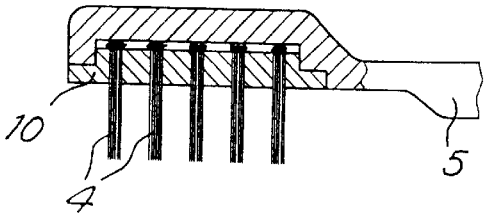

In FIGS. 26 and 27 finally is represented that the holder 10 may form a part of the brush body 5, whereby a covering element 34 is provided above the melted-together extremities of the fiber bundles 4, whether or not after a certain substance, such as glue or synthetic material, has been provided additionally between this element 34 and the holder 10, in other words, around the fiber bundle extremities, or whereby the fiber bundles 4 are provided in a loose holder 10 which is fixed in the brush body 5, whether or not after the melted-together fiber bundle extremities are mutually connected by glue, synthetic material or such.

It is clear that, instead of providing a covering element 34, the entire space above the fiber bundle extremities can be filled by any kind of suitable material.

It is also clear that for the aforementioned four steps, different combinations of the techniques described in the aforegoing can be applied, which, amongst others, also becomes clear from the mutual references between the claims following hereafter.

Figure 28:
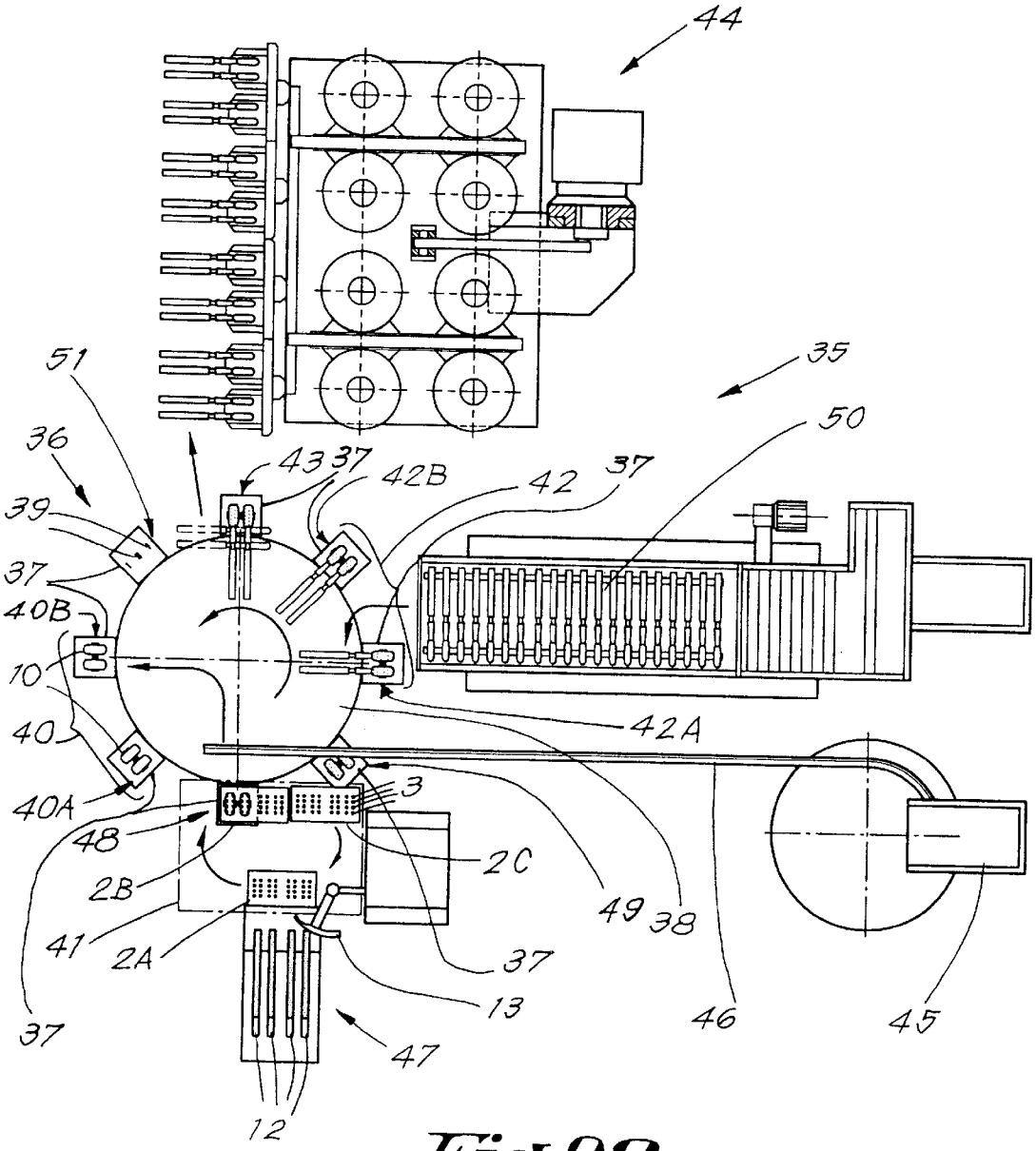
FIG. 28 represents a complete brush manufacturing machine applying the method of the invention.

In FIG. 28, a brush manufacturing machine 35 is represented in top view, in which machine the aforementioned device 1 is integrated.

This machine comprises a closed circuit 36 of clamping devices 37 which are provided at a rotating table 38. These clamping devices 37 are provided with clamps 39 for keeping holders 10 clamped.

Hereby, the clamping devices 37 pass through at least four stations, respectively a feeding station 40 where the feeding of the holders 10 is performed, an attaching filling station 41 where the holders 10 are filled with fiber bundles 4, a station 42 where the additional part of the toothbrush, either the covering element 34, or a part of the brush handle, is provided, and a transporting station 43 where the brush bodies 5 provided with fiber bundles 4 are transported off for a possible finishing in a finishing device 44.

The feeding station 40 for feeding the holders 10 can be made such that it is suitable for manual feeding or for automatic feeding, or for both. In the represented example, the feeding station 40 comprises a part 40A for manual feeding and a part 40B for automatic feeding. With automatic feeding, the holders 10 are supplied from a stack magazine 45 or such by means of an automatic supply device 46, such as a vibratory feeding device. Such systems are sufficiently known in themselves and therefore will not be discussed in detail in the following.

The filling station 41 for filling or inserting the fiber bundles 4 into the holders 10 preferably consists, as represented, of a machine part with various circulating carriers, in this case, three carriers 2A, 2B, and 2C. Each carrier comprises several groups of openings 3, in this case, for four filling patterns.

These carriers 2A, 2B, and 2C circulate between, on one hand, a separating station 47 where the fiber bundles 4, as mentioned before, are separated laterally from one or more fiber magazines 12 by means of one or more fiber bundle take-up devices 13 and are placed in the openings 3 and, on the other hand, a discharge station 48 where the fiber bundles 4 are brought from the respective carrier 2A-2B-2C into the holders 10 situated below. As represented, preferably more than two carriers, in this case, the three carriers 2A-2B-2C, will circulate in order to render the process continuous.

It is noted that each clamping device 37 preferably can comprise more than one holder 10. In the represented example, this is two holders at a time. The advantage thereof is that several holders 10 can be filled simultaneously in the filling station 41 and a larger production speed can be guaranteed.

Preferably, in the filling station 41 the fibers of the fiber bundles 4 also are adhered to the holders 10 by means of heat, glue, resin or such. The fixation of the fibers in the holders 10, however, may take several processing stations. So, for example, it is possible to provide for an additional melting together at the height of the indicated station 49.

In station the attaching 42, each holder 10 is combined with a complementary part. In the case of FIG. 28, this means that brush bodies 5, as represented in FIG. 27, are provided and attached at the clamped holder 10. In the part 42A, the brush bodies 5 are supplied to the holders 10, in this case automatically by means of an automatic supply device 50, from a stack magazine or such. In part 42B, the complementary parts are attached to each other, either by means of a click-on system, or by means of ultrasonic welding, or in any other manner. a variant, in a manual or semi-automatic supply of the complementary parts, more particularly the brush bodies 5.

In the transporting station 43, the obtained products are transported off, either simply ejected, or guided on to the already mentioned finishing device 44.

It is noted that in the circuit 36, apart from the already mentioned stations 40-41-42-43, other stations may also be included, such as, for example, a cleaning station 51, where fiber scraps and dust from previous cycles are removed.

In the finishing device 44, various treatments may be performed. In the case that one is working with fibers with fiber extremities which have not been rounded off in advance, those can be rounded off in the finishing device 44.

Other treatments which can be performed in this finishing device 44 are, amongst others, the provision of markings, such as date, machine number, production data, trademark, etc.; the finishing of the handle, for example, by providing a heat-sensitive film or by printing over the handle; and the inspection of the end product for its quality. As all these different treatments take place spread over several stations, this machine preferably shall consist of a closed circuit of clamping devices which transport the products from one processing station to the following.

In the case that the fibers are already rounded off in advance, it is clear that no rounding off will be required subsequently, but the other steps, of course, still can be applied.

The present invention is in no way limited to the embodiments described heretofore and represented in the drawings, on the contrary, devices applying the method according to the invention may be realized in a variety of forms and dimensions without leaving the scope of the invention.

What is claimed is:

1. A method for manufacturing brushes, comprising:

providing a device comprising at least one carrier (2) with openings (3) which are mutually arranged according to a certain pattern;

separating laterally fiber bundles (4) from at least one quantity of loose fibers (7);

inserting in a mechanical manner, step-by-step, of the fiber bundles (4) in the carrier (2);

transferring the fiber bundles (4) which are placed in the carrier (2) to a holder (10); and fixing the fiber bundles (4) in at least a portion of the brush body.

2. The method according to claim 1, wherein, in the step of separating the fiber bundles (4), at least one fiber magazine (12) and a fiber bundle take-up device (13) cooperate together such that the fiber bundle take-up device (13) is moved along the fibers (7) of the fiber magazine (12), the fiber bundle take-up device is provided with a recess (14) to receive the fibers (7), such that the fiber bundles (4) are separated from the fiber magazine (12) and are subsequently provided in the carrier (2).

3. The method according to claim 1, wherein, in the step of separating the fiber bundles (4), the thickness of the separated fiber bundles (4) is changeable and controlled according to a particular cycle, by using a bundle take-up device (13) having a recess into which at least one fiber bundle (4) is separated from the loose fibers (7), and the size of the recess (14) being adjusted.

4. The method according to claim 1, wherein, in the step of inserting the fiber bundles (4) to the holder (10), the separated fiber bundles (4) are positioned in the openings (3) of the carrier (2) by positioning each of the respective separated fiber bundles (4) into a respective one of the openings (3), and subsequently pushing the separated fiber bundles (4) into the openings (3).

5. The method according to claim 4, wherein, the step of separating fiber bundles (4) is performed by a fiber bundle take-up device (13), in the step of inserting the fiber bundles (4) in the carrier (2), and the fiber bundles (4) are pushed from the fiber bundle take-up device (13) immediately into the openings of the carrier (2).

6. The method according to claim 4, wherein, the step of separating fiber bundles (4) is performed by a fiber bundle take-up device (13) in the step of inserting the fiber bundles (4) in the carrier (2), and the separated fiber bundles (4) are positioned in respective openings of the carrier (2) by a transfer device (17) positioned adjacent the carrier (2) that transfers fiber bundles (4) from the fiber bundle take-up device (13) and in the openings (3).

7. The method according to claim 1, wherein, the openings (3) of the at least one carrier (2) are shaped differently in the cross-section of the separated fiber bundles (4) and the separated fiber bundles (4), in respect to their cross-sections are re-shaped during the transfer to the carrier (2) in order to obtain a shape which is adapted to the different shapes of the respective openings (3).

8. The method according to claim 1, wherein, in the step of inserting the fiber bundles (4) in the carrier (2), the separated fiber bundles (4) are presented to the carriers (2) on at least one or more well-defined locations and the respective carriers (2) are subjected to a positioning cycle such that the separated fiber bundles (4) are systematically presented to the openings (3) of the carriers.

9. The method according to claim 1, wherein, in the step of transferring fiber bundles (4) the separated fiber bundles (4) are pushed into the openings (3) of one or more of the at least one carrier (2) and, after the carrier (2) is filled with fiber bundles (4) and has been presented to a holder (10), the fiber bundles (4) taken up in the carrier (2) are removed from the openings (3) in order to be placed directly or indirectly into the holder (10).

10. The method according to claim 9, wherein, in the step of transferring the fiber bundles (4), the fiber bundles (4) positioned in each of the at least one carrier (2) are brought from the carrier (2) into the respective holder (10) by pushing the fiber bundles (4) out of the carrier (2) with ejection pins (26).

11. The method according to claim 1, wherein, in the step of fixing the fiber bundles (4), the fiber bundles (4) with their extremities which are intended to form free extremities of brush hair, are arranged according to a desired profile.

12. The method according to claim 1, wherein, in the step of transferring the fiber bundles (4), a fiber guidance (31) is provided which either places some of the fiber bundles (4) in a well-defined direction, brings some of the fiber bundles (4) together or guides some of the fiber bundles (4) to another location, or any combination thereof.

13. The method according to claim 1, wherein the holder (10) comprises an already previously formed portion of the brush body.

14. The method according to claim 1, wherein the holder (10) comprises a portion that is provided with through openings (27), and in the step of fixing the fiber bundles (4), the fiber bundles (4) with their respective extremities are brought through the openings (27) of the holder (10), the extremities of fiber bundles (4) protruding through the portion of the holder (1) are subsequently adhered to each other and/or fixed in the respective portion of the older (10).

15. The method according to claim 14, wherein, the extremities of the fibers (7) and the fiber bundles (4), respectively, which protrude through the portion of the holder (10) that is provided with the through openings (27) are subjected to a technique selected from a group consisting of melting together of the fibers (7) by heat, melting to each other of the fiber bundles (4) by heating and flattening the respective extremities, mutually connecting the fibers (7) or fiber bundles (4) by a connecting substance, casting of the fiber bundles (4) from the fibers (7), sealing of the fibers (7), at least next to a foot at which they protrude through the holder (10).

16. The method according to claim 14, wherein the connecting substance is a glue.

17. The method according to claim 14, wherein the connecting substance is a synthetic material.

18. A device for manufacturing brushes, comprising:

at least one fiber magazine (12) with loose fibers (7);

a separator that laterally separates fiber bundles (4) from the loose fibers (7) of the fiber magazine (12);

at least one carrier (2) having openings that are arranged according to a certain pattern;

a mechanism that inserts the fiber bundles (4) into the openings in a step-by-step, mechanical manner; and a transfer device connected to the at least one carrier and configured to transfer the at least one carrier (2), filled with fiber bundles (4), to a holder (10), whereby the fiber bundles (4) are fixed into the brush body.

19. The device according to claim 18, wherein, the fiber bundle take-up device (13) for the lateral separation of fiber bundles (4) comprises a to-and-fro movable fiber bundle take-up device (13) which is provided with a recess (s14);

the carrier (2) comprises a plate with through openings (3); and the device further comprises a moving device (24) in the form of ejection pines (26) that transfer the fiber bundles (4) from the carrier (2) to the holder (10).

20. The device according to claim 18, wherein, the device further comprises a closed circuit (36) of clamping devices (37) which pass at least four stations that comprise.

a feeding station (40) where the feeding of the holders (10) takes place, a filling station (41) where the holders (10) are filled with fiber bundles (4), an attaching station (42) where an additional portion of the brush is attached, and a transporting station (43) where the brush bodies (5) provided with fiber bundles (4) are transported off.

21. The device according to claim 20, wherein the attaching station (42) comprises a machine part with different carriers (2A-2B-2C) circulating therebetween;

the device further comprises a separating station (47) where the fiber bundles (4) are separated laterally from one or more of the fiber magazines (12) by one or more fiber bundle take-up devices (13) and are placed into the openings (3) of the carriers, and a discharge station (48) where the fiber bundles (4) are discharged from the respective carriers (2A-2B-2C) into the holders (10).

22. The device according to claim 18, a wherein the additional portion of the brush is a covering element (34).

23. The device according to claim 18, wherein the additional portion of the brush is a portion of a handle of the brush.

24. The device according to claim 18, wherein the brush bodies (5) provided with fiber bundles (4) are transported off to a finishing device for finishing treatment.

25. The device according to claim 21, wherein each of the clamping devices (37) comprises several places for the clamping of the holders (10) and each of the carriers (2A-2B-2C) has different filling patterns, whereby from each of the carriers (2A-2B-2C) several of the holders (10) of one of the clamping devices (37) can be filled simultaneously.

* * * * *